US006135282A

United States Patent [19]

Tandon et al.

[11] Patent Number: 6,135,282

[45] Date of Patent: Oct. 24, 2000

[54] HOSE PACKAGE AND METHOD OF MAKING AND BLANK COMPRISING SAME

[75] Inventors: Bipin Tandon, Marion; Robert B. Eckert, Nevada, both of Ohio

[73] Assignee: Dayco Products, Inc., Dayton, Ohio

[21] Appl. No.: 08/993,561

[22] Filed: Dec. 18, 1997

[51] Int. Cl.[7] ..... B65D 85/04

[52] U.S. Cl. ..... 206/395; 206/408

[58] Field of Search ..... 206/389, 395, 206/396, 397, 398, 408, 410, 303

[56] References Cited

U.S. PATENT DOCUMENTS

| | | | |
|---|---|---|---|
| 1,165,979 | 12/1915 | Knothe | 206/395 |
| 3,402,501 | 9/1968 | Davis | 206/395 |
| 4,572,370 | 2/1986 | Cedenblad et al. | 206/408 X |
| 5,642,866 | 7/1997 | Nieding | 206/395 X |

OTHER PUBLICATIONS

Prior Art Referred to on p. 1 of Specification Under "Prior Art Statement".

*Primary Examiner*—Jacob K. Ackun
*Attorney, Agent, or Firm*—Joseph V. Tassone

[57] ABSTRACT

A hose package comprising a coiled hose having an inside substantially cylindrical surface means and an outside cylindrical surface means defined by adjoining individual coils. A hose board is held on the hose and is adapted to have hose identification thereon and holding means holds the hose in coiled relation. The board is defined by a strip which is at least partially wrapped against the hose and has a terminal end which is spaced from the inside cylindrical surface means to enable a hanger for the hose package to readily engage the inside substantially cylindrical surface means.

9 Claims, 2 Drawing Sheets

HOSE PACKAGE AND METHOD OF MAKING AND BLANK COMPRISING SAME

BACKGROUND OF THE INVENTION

1. Field of the Invention

This invention relates to a new hose package and a new method of making such a hose package together with a blank utilized in making such a hose package.

2. Prior Art Statement

It is known in the art to provide a hose package which comprises a coiled hose and a disc, or more popularly referred to as a board, which is disposed at one end of the coiled hose and the hose is held in coiled relation with the disc fastened thereon by a plurality of ties which may be in the form of tie wires, or the like. It is also known in the art to provide a so called hose package in which the coiled hose is held in coiled relation together with a primarily circular disc held thereon at one end thereof with heat sealed straps.

SUMMARY OF THE INVENTION

It is one feature of this invention to provide a new hose package comprising a coiled hose having an inside substantially cylindrical surface means defined by adjoining individual coils of the hose, a board held on the hose and adapted to have hose identification thereon and holding means for holding the hose in coiled relation wherein the board is of a novel and improved construction.

In particular, it has been found in accordance to the teachings of this invention that the board is defined by strip which is at least partially wrapped against the hose and wherein the strip has a terminal end which is spaced from the inside substantially cylindrical surface means of the hose to enable a hanger for a hose package to readily engage the inside substantially cylindrical surface means of the hose.

For example, one embodiment of this invention comprises a hose package which comprises a coiled hose having an inside substantially cylindrical surface means defined by adjoining individual coils of the hose, a board held on the hose and adapted to have hose identification thereon and holding means for holding the hose in coiled relation and wherein the board is defined by a strip which is at least partially wrapped against the hose and the strip has a terminal end which is spaced from the inside cylindrical surface means to enable a hanger for the hose package to readily engage the inside substantially cylindrical surface means and hold the hose package on a peg board or similar device enabling the hose package to be displayed with its strip readily visible with advertising thereon to enhance the sale potential of such hose package.

Accordingly, it is an object of this invention to provide a new hose package having one or more of the novel features of this invention as set forth above or hereinafter shown or described.

Another object of this invention is to provide a new method of making a hose package, the method of this invention having one or more of the novel features of this invention as set forth above or hereinafter shown or described.

Another object of this invention is to provide a blank for a hose identification board which comprises the novel hose package of this invention having one or more of the novel features of this invention as set forth above or here in after shown or described.

Other objects, uses, and advantages of this invention are apparent from a reading of this description which proceeds with reference with accompanying drawings forming a part thereof and wherein.

DESCRIPTION OF ILLUSTRATED EMBODIMENTS

Figure 1:
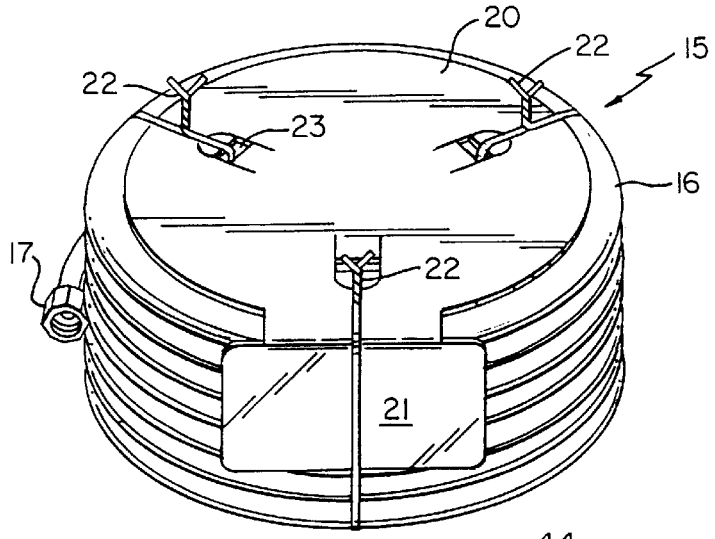
FIG.1 PRIOR ART
FIG. 1 is a perspective view illustrating a prior art hose package.

While all the various features of this invention are hereinafter illustrated and described as being particularly adapted to provide a hose package comprised of a common ordinary garden hose and associated board, it is to be understood that the various features of this invention can be used singly or in various combinations thereof to provide a hose package comprised of other types of hoses for conveying other fluids, other than water, as desired.

Therefore, this invention is not to be limited to only the embodiments illustrated in the drawings, because the drawings are merely utilized to illustrate one of the wide variety of uses of this invention.

Reference is now made to FIG. 1 of the drawings which illustrates a prior art hose package which is designated generally by the reference numeral 15. The package 15 is comprised of a coiled garden hose having the usual fittings of opposite ends thereof and this example of the invention such prior art hose package 15 is illustrated with a female fitting 17 and the opposite fitting is not shown. The hose package 15 has a disc at one end thereof which is popularly referred to as a board 20 and the board 20 is of circular outline and has a tab 21 extending from one edge of the circular configuration thereof.

The package 15 has a plurality of three fasteners in the form of fastening ties each designated by the same reference 22 which extend through corresponding openings each designated by the same reference 23 in the circular portion of the board 20 and the ties serve to hold the hose 16 in coiled relation while also holding the board 20 in position at one end of the coiled hose 15. As is known in the art each of the ties 22 may have its ends twisted together and may be comprised of any suitable material such as plastic or paper coated metal wire material, or the like.

It is also known in the art to provide heat-sealed straps, not shown, instead of the ties 22 to hold a circular disc similar to the disc 20 at one end of the prior art hose package 15 while effectively holding the hose 16 in coiled relation.

The hose 16 and disc 20 whether held by twist ties 22 or heat-sealed straps, not shown, defines a cylindrical assembly having an end which is effectively closed and it is not possible to place the prior art hose 15 on a hanger or similar device for display purposes without damage to the disc or board 20. In addition, it requires time consuming effort, and/or special precision equipment when the prior art package 15 is assembled due to the fact that a plurality of three ties or straps 22 need to be inserted within the three openings 23.

Figure 3:
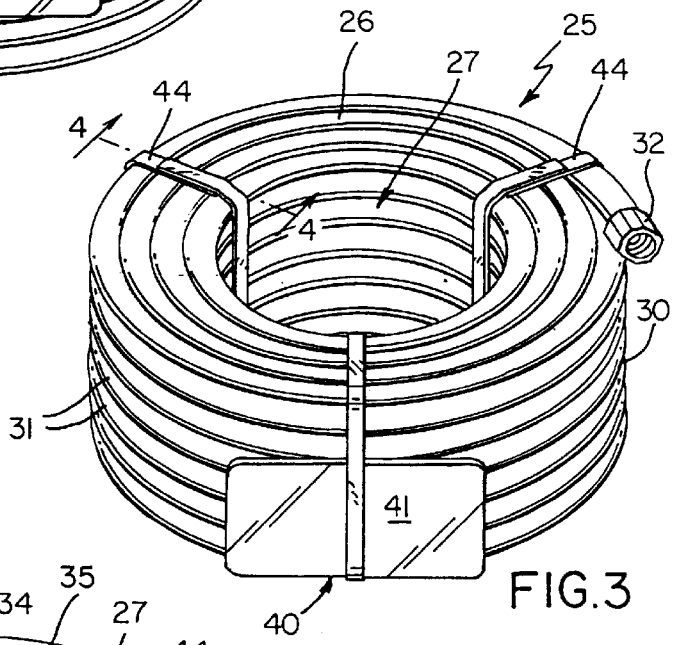
FIG. 3 is a view similar to FIG. 2 of the hose package of this invention but illustrating such hose package inverted.

Reference is now made to FIG. 3 of the drawings which illustrates one exemplary embodiment of the hose package of this invention and such hose package is designated generally by the reference numeral 25. The hose package 25 comprises a coiled hose 26 having an inside substantially cylindrical surface means designated generally by the reference numeral 27 and an outside substantially cylindrical surface means designated generally by the reference numeral 30 and the inside surface means 27 and the outside surface means 30 are defined by adjoining individual coils of the hose 26 and a representative few of such coils are designated by the reference numeral 31.

The hose 26 has the usual fittings at opposite ends thereof and this example an internally threaded or so called female fitting 32 is shown at one end thereof. An externally threaded male fitting is provided at the opposite end of the hose 26 and such fitting is not visible in the drawing of this example of the invention.

The hose package 25 has the board 33 of this invention comprising same and the board 33 is held on the hose 26 and is adapted to have hose identification thereon. The identification is for the hose itself and advertising for such hose as is common in the art.

Figure 2:
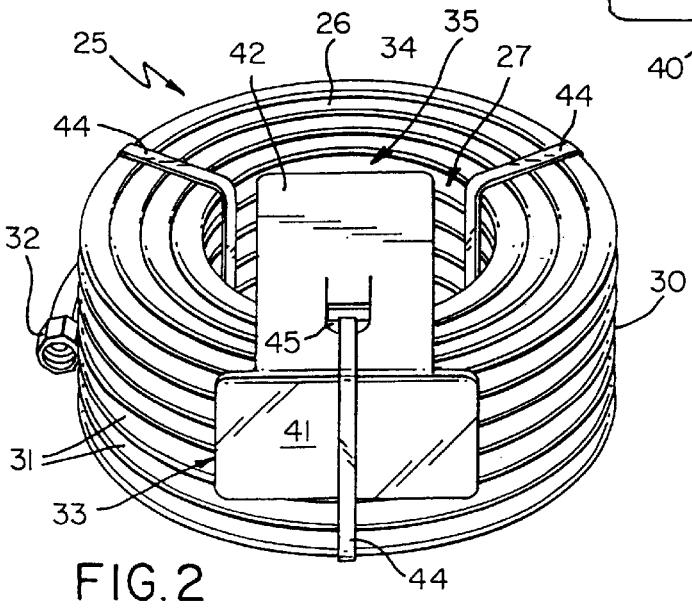
FIG. 2 is a perspective view similar to FIG. 1 illustrating the improved hose package of this invention and illustrating an identification board at one end thereof.
Figure 6:
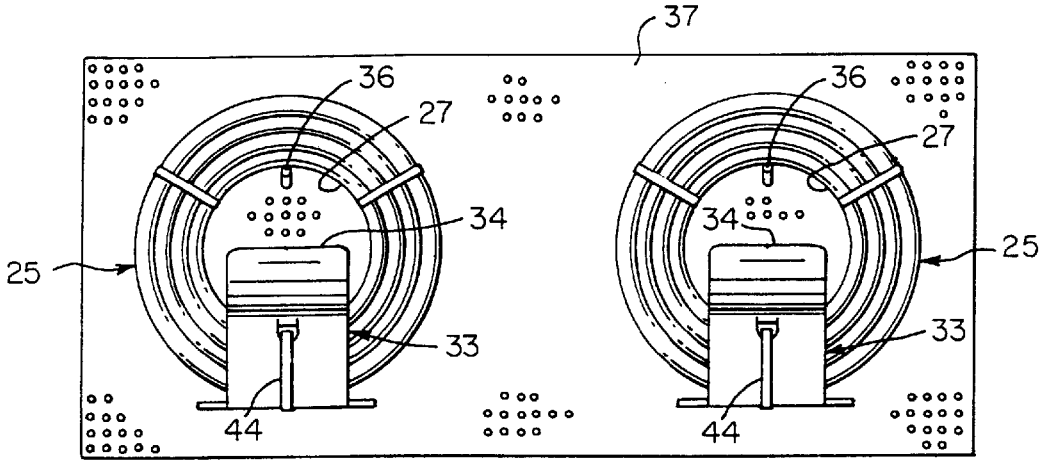
FIG. 6 is a view illustrating a pair of hose packages of this invention supported on a pair of hangers for display purposes.

The board 33 may also be defined as a strip which is at least partially wrapped against the hose as illustrated in FIGS. 2 and 3 and the strip has a terminal end 34 which is spaced from the inside cylindrical surface means 27 by distance illustrated by 35 to enable a hanger such as a rod 36, illustrated in FIG. 6, for the overall package 25 to readily engage the inside substantially cylindrical surface means 27 and thereby display the package 25 on a peg board 37 or the like without damaging the strip 33 or without interfering in any manner with such strip. As seen in FIGS. 2 and 3 the strip 33 is at least partially wrapped against the hose 26 as illustrated at 40 in FIG. 3.

The strip 33 has a first portion 41 thereof wrapped against the outside cylindrical surface means 30 and has a second portion 42 thereof disposed at an angle transverse to the first portion 41. The strip 33 is a roughly T-shaped strip comprised of a leg and an adjoining cross arm. The cross arm defines the first portion 41 and the leg defines the second portion 42 and the leg has a free end which defines the free terminal end 34.

The hose package 25 also has holding means holding the hose in coiled relation and the holding means in this example of the invention comprises of plurality of fastening members each designated by the reference numeral 44 and one of the fastening members 44 extends through an opening 45 in the strip 33 and sandwiches at least the first portion 41 against the outside cylindrical surface means 30. Each fastening member 44 in this example of the invention is in the form of a strap 44 which is heat sealed in fastening relation around the coiled hose 26.

Figure 4:
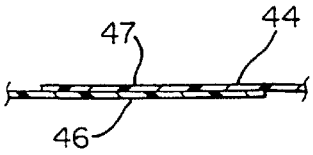
FIG. 4 is a cross-sectional view taken essentially on the line 4—4 of FIG. 3.

Although the strap 44 may be made of any suitable plastic heat-sealable material such strap in this example of the invention is made of polypropylene. As seen in FIG. 4 of the drawings each strap 44 has its opposite terminal ends 46 and 47 disposed in overlapping heat sealed and thus fastened relation around the coiled hose 26.

Figure 5:
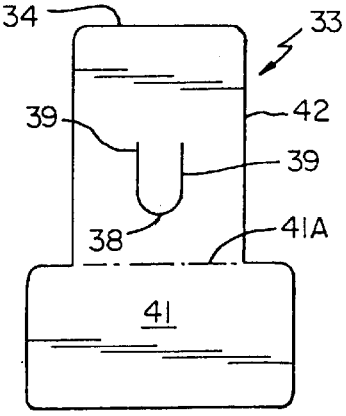
FIG. 5 is a plan view of a blank utilized to make the board comprising the hose package of FIGS. 2 and 3.

The strip 33 is in the form of a roughly T-shaped strip 33 as previously described and such strip is defined by the blank illustrated in FIG. 5, and such blank will also be designated by the reference numeral 33. The strip or blank 33 is adapted to be at least partially wrapped and held on the hose 26 to define the hose package 25. The blank 33 comprises the previously described first portion 41 and second portion 42 separated by rectilinear scoreline 41A and a u-shaped cut in the second portion 42 defined by a bight 38 and a pair of parallel legs 39 extending from opposite ends of the bight ends defining a tab T. The tab T is bendable out of the usual plane of the second portion 42 to define an opening, illustrated as opening 45 in FIG. 2, which is adapted to receive a faster in the form of a fastening strap 44 therethrough and hold the hose 26 in coiled relation as well as hold the strip or blank 33 fastened against the hose 26 of the package 25.

This invention provides an improved method of making a hose package which comprises the steps of coiling the hose 26 to define adjoining individual coils in stacked relation and define the inside substantially cylindrical surface means 27 and the outside substantially cylindrical surface means 30. The method steps also include providing the hose identification board 33 and disposing the identification board on the coiled hose 26 and providing holding means 44 and holding the hose 26 in coiled relation with such holding means.

In accordance with the teaching of this invention the step of providing the identification board comprises providing the board as a strip 33 and at least partially wrapping the strip 33 against the hose 26. In one embodiment of the method of this invention the step of providing the board as a strip comprises defining a roughly T-shaped strip consisting of a leg 42 and transverse arm 41, and it will be seen that the strip 33 has a terminal end 34 which is spaced from the inside substantially cylindrical surface means 27 following the wrapping step to enable a hanger 36 for the package 25 to readily engage the inside substantially cylindrical means 27 and suspend the package on a peg board, or the like, as previously described in connection with FIG. 6.

The step of wrapping the strip comprises wrapping a first (arm) portion 41 of the strip against the outside cylindrical surface means 30 and disposing a second (leg) portion 42 thereof at angle transverse to the first portion. In accordance with the teachings of this invention, the step of holding the hose 26 in coiled relation with the holding means comprises providing a fastening member or fastening strap 44 and extending the fastening member 44 through an opening 45 in the strip 33 to sandwich at least the first portion 41 of the strip and in particular the cross arm portion 41 of the strip against the outside cylindrical surface means. Thereafter, opposite ends 46 and 47 of the strap 44 are disposed in overlapping relation and suitably heat sealed together using any suitable heat-sealing technique known in the art.

Figure 7:
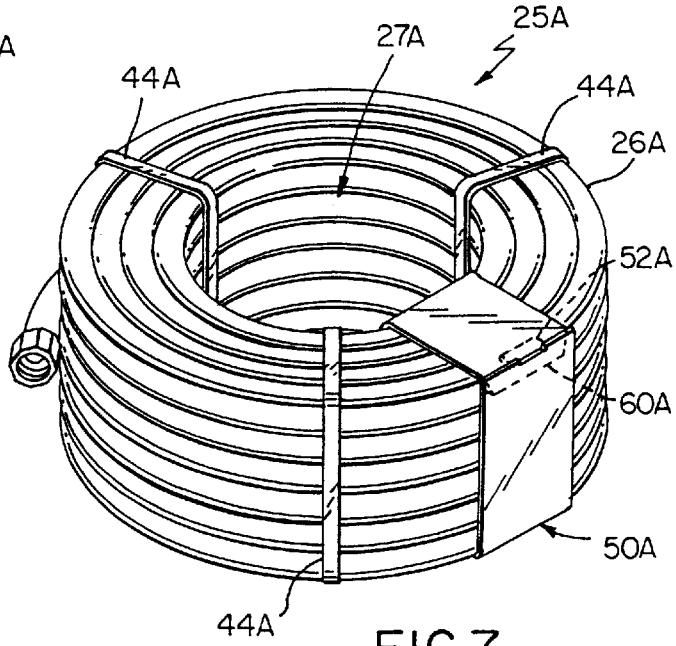
FIG. 7 is a perspective view similar to FIG. 2 illustrating another exemplary embodiment of a hose package of this invention which utilizes another embodiment of a board for such hose package.

Another exemplary embodiment of the hose package of this invention is illustrated in FIG. 7 of the drawings. The hose package illustrated in FIG. 7 is similar to the hose package 25; therefore, such hose package will be designated by the reference numeral 25A and component portions of the hose assembly 25A which are similar to corresponding portions of the hose assembly 25 will be designated in the drawings by the same reference numerals as in the hose package 25 (whether or not such component portions are mentioned in the specifications) followed by the letter designation A and not described again in detail. Only those component portions of the hose assembly 25A which are different from corresponding portions of the hose assembly 25 will be designated by a new reference numeral also followed by the associated letter designation and described in detail.

The hose 25A of FIG. 7 has a board in the form of a strip 50A which is wrapped against the coiled hose 26A and such strip 50A is self held against and around the coiled hose 26A as will be described in detail subsequently. The strip 50A enables a hanger such as the hanger 36 shown in FIG. 6 in connection with the package 25 to readily engage the inside cylindrical surface means 26A of the hose 25A and hold the package 25A for display purposes on a display board such as the peg board 37 illustrated in FIG. 6.

The strip 50A is in the form of an elongated rectangular strip and

Figure 8:
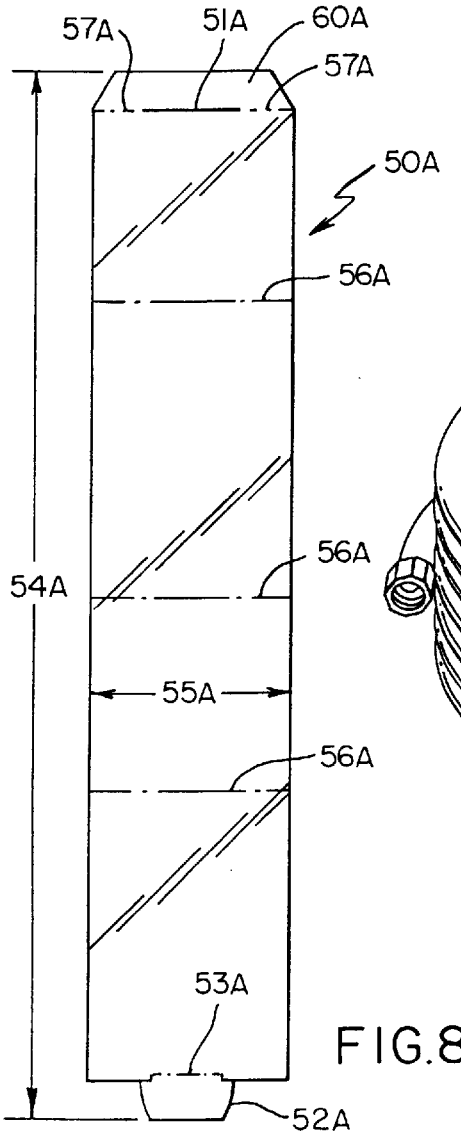
FIG. 8 is a plan view of a blank utilized to make the board which comprises the package of FIG. 7.

FIG. 8 illustrates a blank utilized to make the strip 50A. The blank and strip will be designated by the same reference numeral 50A for easy reference thereto. The strip 50A has slit means or a slit 51A adjacent one-terminal end thereof and has an arrowhead-shaped projection 52A defining the opposite terminal end thereof. The arrowhead projection 52A is bendable about a score line 53A. The projection 52A is adapted to be received within the slit means 51A with the strip wrapped around at least one of the coils of the package 25A; and, in this example of the invention the strip 50A is wrapped around the entire coiled hose 26A and comprises package 25A and is held in position by the arrowhead projection 52A received within the slit 51A whereby the strip is a self-held strip 50A.

Referring now to FIGS. 7 and 8 of the drawings, the strip 50A has a length 54A which is quite substantial and a comparatively narrow width 55A. The strip 50A has a plurality of scorelines each designated by the same reference numeral 56A disposed in parallel spaced apart relation along its length 54A and each scoreline 56A extends across the entire width. The scorelines 56A enable the strip to be wrapped around all of the coils defining the hose 26A of the package 25A. The strip 50A also has a pair of spaced apart scorelines 57A at opposite ends of the slit 51A which allow a trapezoidal projection 60A defining one terminal end of the strip 50A to be bent about the scorelines 57A and about the slit 51A as illustrated at 61A in FIG. 7 whereby the trapezoidal tab 60A is disposed beneath an adjoining portion of the strip 50A as illustrated at 62A in FIG. 7.

The hose package 25A also has holding means 44A holding the hose 26A in coiled relation and the holding means of the hose package 25A are very similar to the holding means 44 of the package 25. It will be seen that the holding means 44A is in the form of straps 44A which are spaced roughly 120° apart on the circular peripheral outline of the coiled hose 26A. The board or rectangular strip 50A is disposed between an associated pair of the straps 44A.

Each of the strips 33 and 50A comprising the respective packages 25 and 25A may be made of any suitable material known in the art and such strips in one exemplary embodiment of the invention are made of paperboard. The paperboard will have suitable identification means placed thereon such as printing, advertising, the nomenclature for the coiled hose, warranty information, and the like. It will also be appreciated that each of the strips 33 and 50A may be made of plastic material or paper material that has been coated with plastic, or the like and suitably provided with identification means. Each of the straps 44 and 44A comprising the packages 25 and 25A may be made of any suitable heat sealable material and as previously mentioned each of the straps is preferably made of polypropylene.

A typical polypropylene strap generally may be white in color, has a nominal width of 7 millimeters and has a nominal thickness of 0.022 inch. The nominal breaking strength of such a strip is approximately 200 pounds. In one exemplary embodiment of the invention a fastening strap was made in accordance with ASTM standard designation D-3950. It will also be appreciated that each fastening strap 44 or 44A may be of any other suitable color. One current supplier of fastening straps 44–44A is Polychem, 6277 Heisley Rd., Mentor, Ohio 44060.

The fastening straps 44 and 44A may be fastened in position on their associated hose package utilizing any suitable technique known in the art and preferably such fastening straps are fastened automatically utilizing automatic strapping equipment which utilizes suitable wrapping devices and heat sealing devices as are known in the art whereby the associated ends (such as ends 46 and 47 of strap 44) are disposed in overlapping relation and heat sealed in position once the associated strap is fastened in position around the coiled hose 26. Each of the straps 44 and 44A may be fastened and heat sealed in position utilizing suitable manual means or a combination of manual and automatic means.

The packages 25 and 25A of this invention are preferably utilized to package and sell garden hose however it will be appreciated that any suitable hose product may be packaged in a similar manner utilizing the concept of this invention and in particular utilizing the strips 33 and 50A and holding means in the form of fastening straps 44 or 44A, as described herein.

While the forms and methods of this invention now preferred have been illustrated and described as required by the patent statute, it is to be understood that other forms and method steps can be utilized and still fall within the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and an obvious invention within the purview of the patent statute.

What is claimed is:

1. A blank adapted to be used as a holding means and as an identification board for a fluid conveying hose which is coiled with portions of adjoining individual coils defining inside substantially cylindrical surface means and other portions of adjoining individual coils defining outside substantially cylindrical surface means, said blank being adapted to be at least partially wrapped around said coils of said hose and held on said hose to define a hose package, said blank being fee of substantially circular portions and comprising a first portion and a second portion separated by a single rectilinear score line, a cut in said second portion defining a tab which is bendable out of the usual plane of said second portion to define an opening which is adapted to receive a fastener therethrough and forming part of said holding means to hold said hose in coiled relation, and said hose identification board defined from said first portion of said blank, said blank defined as a roughly T-shaped strip having a leg and a cross arm, said cross arm defining said first portion and said leg defining said second portion, said cut being approximately U-shaped defined by a bight and a pair of parallel legs extending from the opposite terminal ends of said bight to define said bendable tab.

2. In a hose package comprising a coiled hose having inside substantially cylindrical surface means defined by adjoining individual coils, a hose board held on said hose and adapted to have hose identification thereon, and holding means holding said hose in coiled relation, the improvement wherein said board is defined by a strip free of substantially circular portions which is at least partially wrapped against said hose, said strip being roughly T-shaped defined by a leg and a cross arm.

3. A package as set forth in claim 1 wherein said strip has a terminal end which is spaced from said inside cylindrical surface means to enable a hanger for said package to readily engage said inside substantially cylindrical surface means.

4. A package as set forth in claim 3 wherein said coiled hose has an outside substantially cylindrical surface means also defined by adjoining individual coils of said hose, said strip has a first portion thereof wrapped against said outside cylindrical surface means and has a second portion thereof disposed at an angle transverse to said first portion, and said holding means comprises a fastening member which extends through an opening in said strip and sandwiches at least said first portion against said outside cylindrical surface means.

5. A package as set forth in claim 4 wherein said strip is a roughly T-shaped strip comprised of a leg and an adjoining cross arm, said cross arm defines said first portion and said leg defines said second portion and has a free end which defines said terminal end.

6. A package as set forth in claim 5 wherein said fastening member is defined as a strap which is heat sealed in fastening relation around said coiled hose.

7. A package as set forth in claim 6 wherein said strap is made of polyproplylene.

8. A package as set forth in claim 5 wherein said fastening member is defined as a polypropylene strap which has its opposite terminal ends disposed in overlapping heat sealed and thus fastened relation around said hose.

9. A package as set forth in claim 1 wherein said strip is wrapped around said hose while enabling a hanger for said package to readily engage said inside substantially cylindrical surface means.

* * * * *